US007077671B2

(12) United States Patent
Su et al.

(10) Patent No.: US 7,077,671 B2
(45) **Date of Patent: *Jul. 18, 2006**

(54) MEMORY CARD CONNECTOR WITH A PUSH-PUSH MECHANISM

(75) Inventors: Chia-Sheng Su, Tucheng (TW); Ming-Chun Lai, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 9 days.

This patent is subject to a terminal disclaimer.

(21) Appl. No.: 10/923,704

(22) Filed: Aug. 24, 2004

(65) Prior Publication Data

US 2006/0046572 A1 Mar. 2, 2006

(51) Int. Cl.
*H01R 13/62* (2006.01)

(52) U.S. Cl. ..... 439/159

(58) Field of Classification Search ..... 439/159, 439/155

See application file for complete search history.

(56) References Cited

U.S. PATENT DOCUMENTS 6,319,028 B1 * 11/2001 Zhang et al. ..... 439/159
6,361,338 B1 * 3/2002 Chang ..... 439/159
6,554,627 B1 * 4/2003 Chen ..... 439/159
6,776,640 B1 * 8/2004 Nishioka ..... 439/325
6,896,555 B1 * 5/2005 Su et al. ..... 439/630
6,948,956 B1 * 9/2005 Ngo ..... 439/155

* cited by examiner

*Primary Examiner*—Neil Abrams
(74) *Attorney, Agent, or Firm*—Rosenberg, Klein & Lee

(57) ABSTRACT

A memory card connector with a push-push mechanism has a sliding member and a sliding pin. The sliding pin is bent into a specific shape and has a linkage portion and a clasping portion, wherein the clasping portion can be located at predetermined positions of a housing of the memory card connector alternately. The sliding member can be slid to the corresponding positions according to the insertion and the rejection of a memory card. A recess portion is formed on the front end of the sliding member with a retaining hole defined thereon for engaging with the linkage portion. The indented depth of the recess portion on the sliding member is substantially equal to the thickness of the sliding pin so that the top of the sliding pin is substantially at the same level as the surface of the sliding member. Thus, the memory card connector has the advantages of high durability and reliability and reduced thickness.

4 Claims, 13 Drawing Sheets

MEMORY CARD CONNECTOR WITH A PUSH-PUSH MECHANISM

BACKGROUND OF THE INVENTION

1. Field of the Invention

The present invention generally relates to the field of a memory card connector with a push-push mechanism, and in particular to a memory card connector with a push-push mechanism, which has an improved sliding member and a sliding pin for reducing the thickness of the memory card connector and increasing the reliability of the memory card connector.

2. The Related Art

Digital electronic products, such as digital still camera, MP3 player, cellular phone, etc., are required with larger capacity of storage media to satisfy the demand of digital images and music with higher qualities by the users. In general, the capacities of built-in storage media of digital electronic products are not able to meet the requirement of storage capacities by the users. Accordingly, the flash memory cards with the advantages of small size, large capacities, accessing quickly, and easy to install and carry have become the major storage media in the digital electronic products.

For accessing the flash memory cards, the digital electronic products are equipped with electrical connectors adapted to corresponding flash memory card. Most of the electrical connectors have a foolproof design to prevent the failure of the flash memory cards and the digital electronic products resulted from the wrong insert direction. Some electrical connectors have a mechanism for rejecting the flash memory cards, which keeps the angle of the insertion and rejection identical and prevents the failure of the flash memory cards and the digital electronic products.

The electrical connector with a mechanism to reject memory card has a sliding member which can be slid accompanying the insertion and rejection of the memory card. The electrical connector further comprises a circular guiding groove. The guiding groove keeps the memory card in an insertion state while the memory card inserted to a predetermined position. The guiding groove keeps the memory card in a rejection state when the memory card to a rejection position. The mechanism is so called "push-push" mechanism. The push-push mechanism is mostly set with a guiding pin. The guiding pin makes the sliding member stay in the insertion state or rejection state respectively by the slide and fastening of the guiding pin in the circular guiding groove. The sliding member is required movable relatively to the housing of the electrical connector within the electrical connector. Thus, one end of the guiding pin needs to fix on the sliding member or the housing of the electrical connector (it depends on the whole design of the electrical connector), the other end is moved and retained in the circular guiding groove. The sliding member can be switched between the insertion state and the rejection state by the relative position of the guiding pin in the circular guiding groove. Therefore, the memory card can be stayed in the insertion state or rejection state within the electrical connector.

Nevertheless, the prior electrical connector with a memory card rejecting mechanism has a problem of increasing dimension. The guiding pin which is disposed on the guiding member or the housing of the electrical connector will increase the thickness or the width of the electrical connector (it depends on what position of the electrical connector the guiding pin disposed on). The increasing dimension of the electrical connector doesn't conform to the requirement of small size of the digital electronic products presently. Furthermore, the stationary portion of the guiding pin may protrude outside of the electrical connector in prior art. The probability of failure of the electrical connector will be raised in prior art.

SUMMARY OF THE INVENTION

It is therefore a primary objective of the present invention to provide a memory card connector with an improved sliding member and a sliding pin for reducing the thickness of the push-push mechanism. The present invention provides a memory card connector with the sliding member and sliding pin having a higher durability and reliability.

The present invention provides a memory card connector which has a housing. A plurality of terminals are disposed on the housing for electrically connecting with the adapted terminals of a memory card. The housing is provided with a circular guiding groove disposed thereon. The memory card connector further has an improved sliding member and a sliding pin. The sliding pin is bent into a specific shape and includes a linkage portion and a clasping portion, wherein the clasping portion can be located at predetermined positions of the circular guiding groove in a proper order. The sliding member can be slid to the corresponding positions according to the insertion and the rejection of the memory card. A recess portion is formed on the front end of the sliding member. A retaining hole is further formed on the recess portion. The linkage portion of the sliding pin is penetrated through the retaining hole and retained on the recess portion. The indented depth of the recess portion on the sliding member is substantially equal to the thickness of the sliding pin so that the top of the sliding pin is substantially at the same level as the surface of the sliding member. A resilient member is disposed with one end thereof against the housing and the other end thereof against the sliding member for providing the sliding member with a restoring force toward the direction of rejection.

The advantage of the present invention is which the sliding pin is engaged with the sliding member, without protruding out from the surface of the memory card connector. Thus, the probability of failure in the memory card connector according to the present invention can be minimized.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
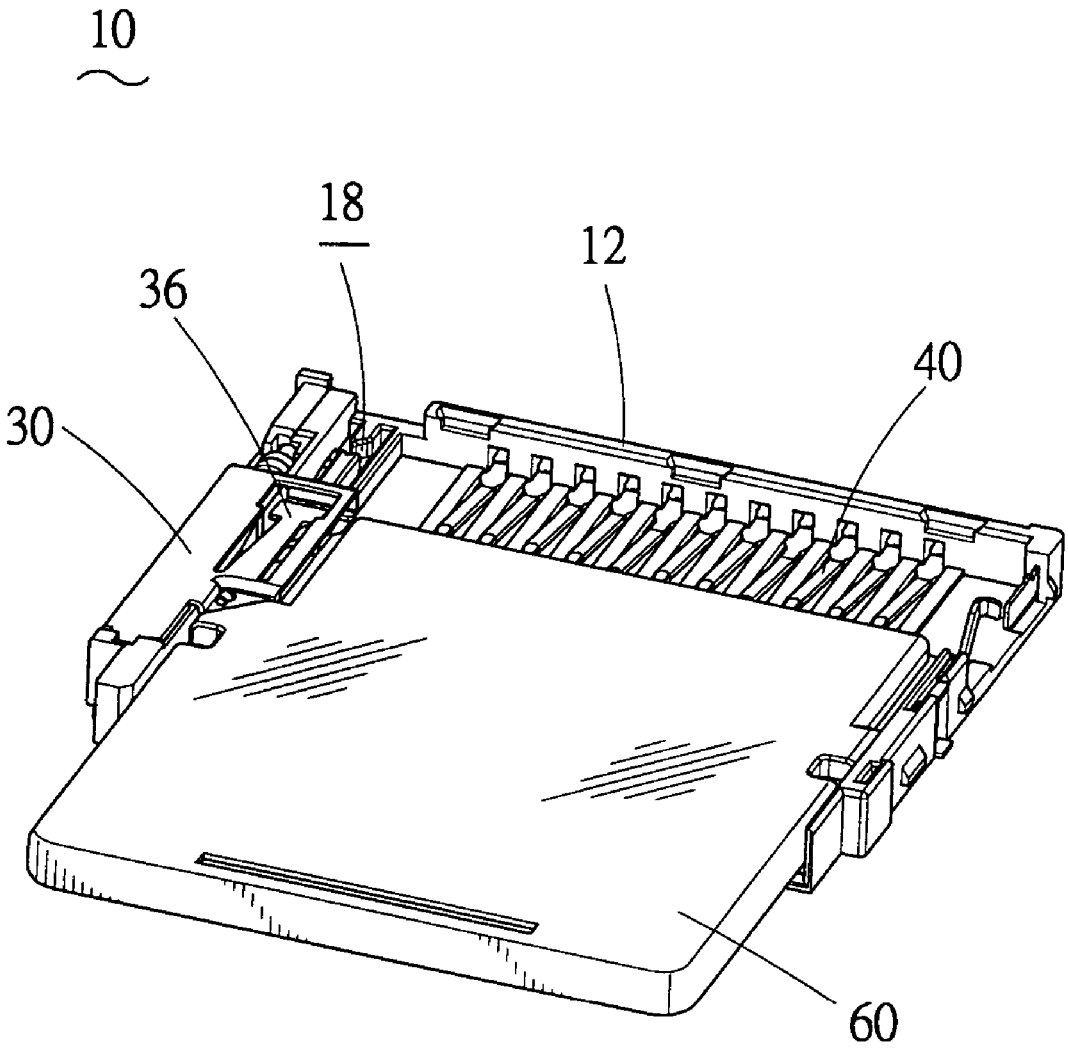
FIG. 1 is a perspective view of a memory card connector in accordance with the present invention.

Please refer to FIG. 1. FIG. 1 is a perspective view illustrating a memory card connector 10 adapted to a memory card 60 according to the present invention. The memory card 60 can be a Mini Secure Digital card (Mini SD card). The memory card connector 10 comprises a housing 12. A plurality of resilient terminals 40 are set on the housing 12. The resilient terminals 40 can be made electrical connection with corresponding terminals (not shown) of the memory card 60 while the memory card 60 is inserted in the memory card connector 10 to an insertion state. A sliding member 30 is set on one side of the memory card connector 10. The sliding member 30 will be described in detail later. The sliding member 30 is accommodated to the housing 12 for guiding the movement of insertion and rejection of the memory card 60. The sliding member 30 holds the memory card 60 in the insertion state when the memory card 60 is inserted to the insertion state. Besides, the sliding member 30 can reject the memory card 60 to a rejection state when the memory card 60 is rejected to the rejection state.

Figure 2:
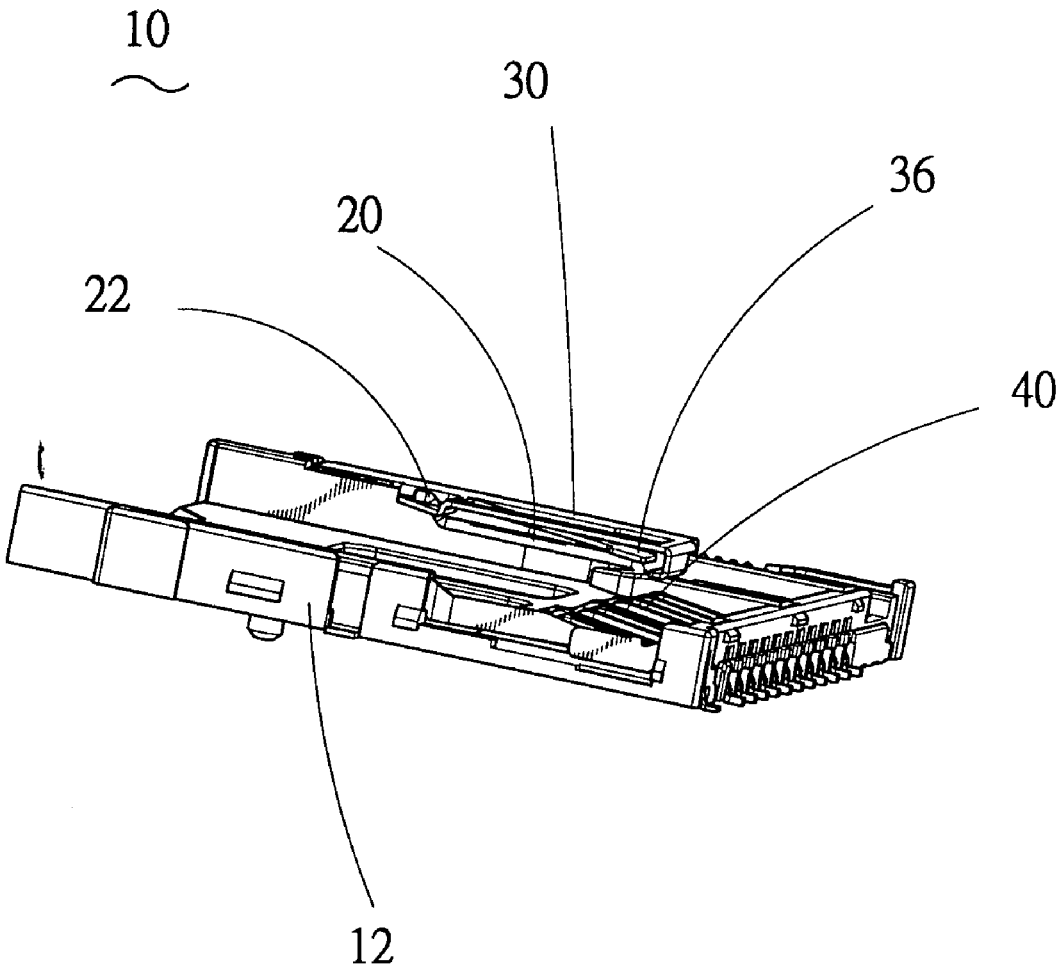
FIG. 2 is an angled view of the memory card connector in accordance with the present invention.
Figure 3:
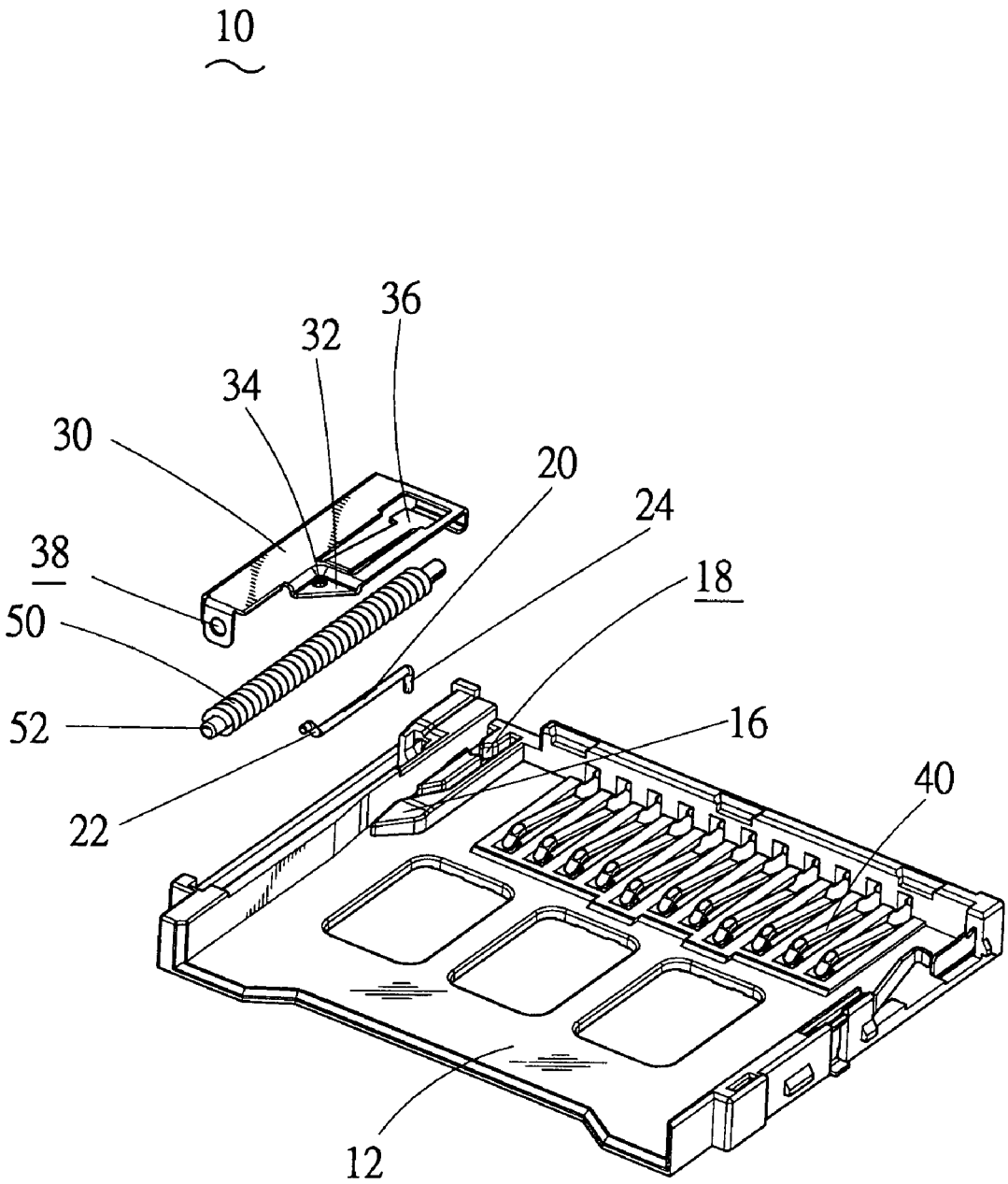
FIG. 3 is an exploded view of the a memory card connector in accordance with the present invention.

Please refer to FIG. 2 and FIG. 3. FIG. 2 is the lateral view illustrating the inside of the memory card connector 10 at an angle. FIG. 3 is the exploded view of the memory card connector 10. A guiding rod 52 is disposed on the housing 12. A guiding hole 38 is formed on the sliding member 30. The guiding rod 52 is penetrated through the guiding hole 38 for constraining the sliding member 30 in a predetermined area. The sliding member 30 slides according to the insertion or rejection of the memory card 60 respectively. A resilient member 50 is assembled with the guiding rod 52. In this embodiment in accordance with the present invention, the resilient member 50 is a hollow coiled spring in a cylindrical shape. The resilient member 50 wraps around the outside of the guiding rod 52. One end of the resilient member 50 is against the housing 12, and the other end is against the sliding member 30. Accordingly, the sliding member 30 is provided with a restoring force toward the rejected direction of the memory card 60. The housing 12 further comprises a projecting portion 16 which is extended inwardly from the side of the memory card connector 10 at an angle for preventing the insertion of the memory card 60 in wrong directions. That is, the memory card 60 will be blocked by the projecting portion 16 when the memory card 60 is inserted in wrong directions. The projecting portion 16 is utilized to prevent the damage of the memory card connector 10 due to the wrong insertion and avoid the memory card 60 jamming within the memory card connector 10.

The memory card connector 10 has a sliding pin 20 disposed with the sliding member 30 in order to accomplish the insertion and rejection of the memory card 60. The sliding pin 20 includes a linkage portion 22 and a clasping portion 24. The linkage portion 22 of the sliding pin 20 is in a slanted S-shape and obliquely penetrated through a retaining hole 34 which is defined in a recess portion 32 formed on the front end of the sliding member 30. The clasping portion 24 is formed on the end of the sliding pin 20 opposite to the linkage portion 22. A circular guiding groove 18 is formed on the bottom of the housing 12 for positioning the clasping portion 24. The clasping portion 24 is bent downward into a substantially right angle for positioning and clasping in the corresponding locations of the circular guiding groove 18.

The sliding member 30 further comprises a depressor 36. The depressor 36 is formed with a metal sheet on the sliding member 30. The depressor 36 depresses the clasping portion 24 of the sliding pin 20 downward so as to force the free end of the clasping portion 24 resiliently retained against the bottom surface of the circular guiding groove 18. Because of the restoring force of the sliding member 30 toward the card rejection direction and the downward stress of the clasping portion 24, the clasping portion 24 can be positioned between the insertion position and the rejection position on the circular guiding groove 18 alternatively. Thus, the sliding member 30 can be retained in the corresponding position by which the clasping portion 24 stays while the memory card 60 is inserted and rejected.

Figure 4:
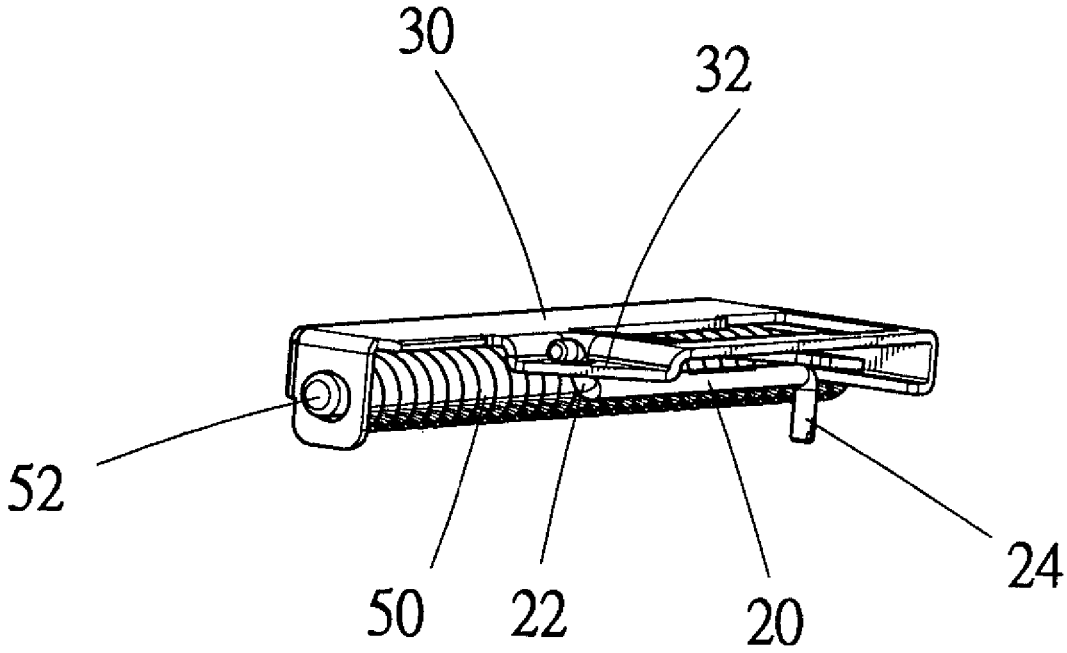
FIG. 4 is a perspective view of the combination of the sliding member and the guiding rod.
Figure 5:
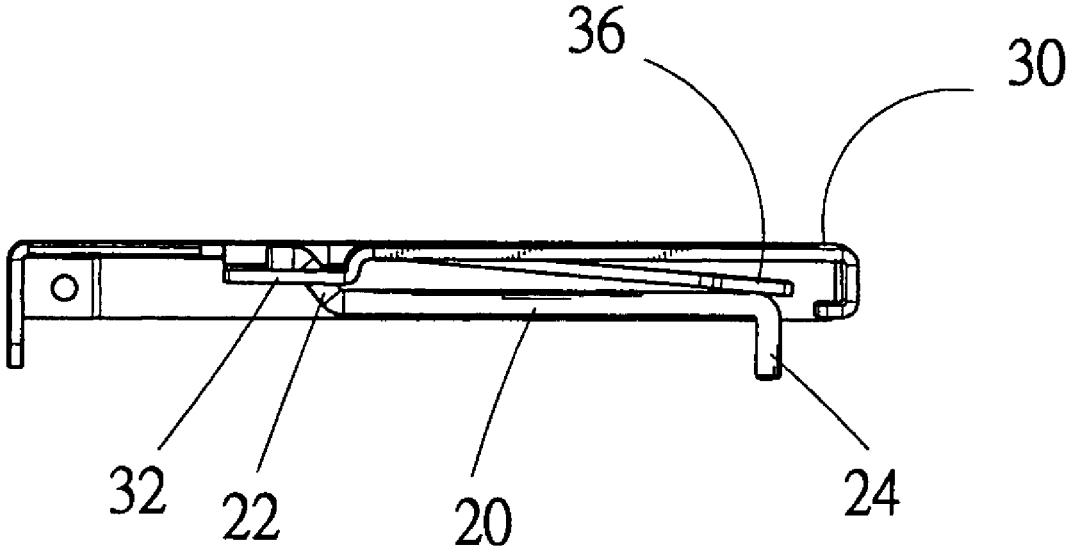
FIG. 5 is a lateral view of the sliding member according to the present invention.
Figure 6:
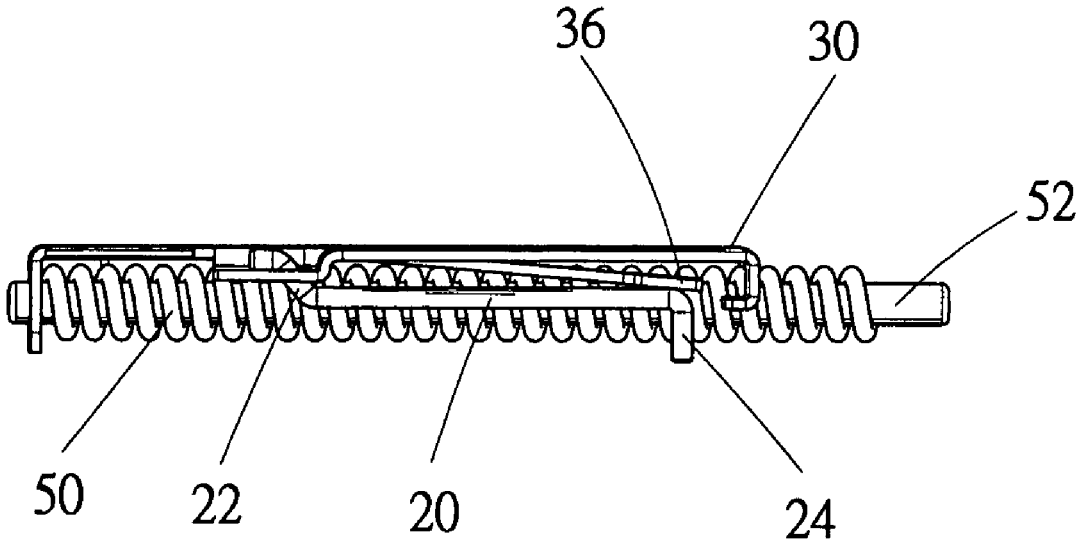
FIG. 6 is a lateral view of the combination of the sliding member and the guiding rod.

Please refer to FIG. 4 to FIG. 6. FIG. 4 and FIG. 6 are the views of the combination of the sliding member 30 and the guiding rod 52 from different angles. FIG. 5 is the lateral view of the sliding member 30. The indented depth of the recess portion 32 on the sliding member 30 is substantially equal to the thickness of the sliding pin 20. Therefore, the top of the sliding pin 20 is substantially at the same level as the top surface of the sliding member 30 after the linkage portion 22 of the sliding pin 20 is inserted into the retaining hole 34. The inward surface of the recess portion 32 is designed into a bevel surface for being contacted with and against the corresponding bevel surface of the memory card 60 in parallel relation. In such manner, the sliding member 30 can be pushed into the insertion state along the path of the memory card 60 via engagement of the two complementary bevel surfaces and retained in the insertion state when the memory card 60 is inserted. The memory card 60 can be retained in the insertion state while the memory card 60 is pushed into the insertion state and held by the memory card connector 10. Contrarily, the memory card 60 can be rejected to the rejection state by the restoring force of the resilient member 50 of the sliding member 30 when the clasping portion 24 of the sliding pin 20 escapes from the insertion position.

Figure 7:
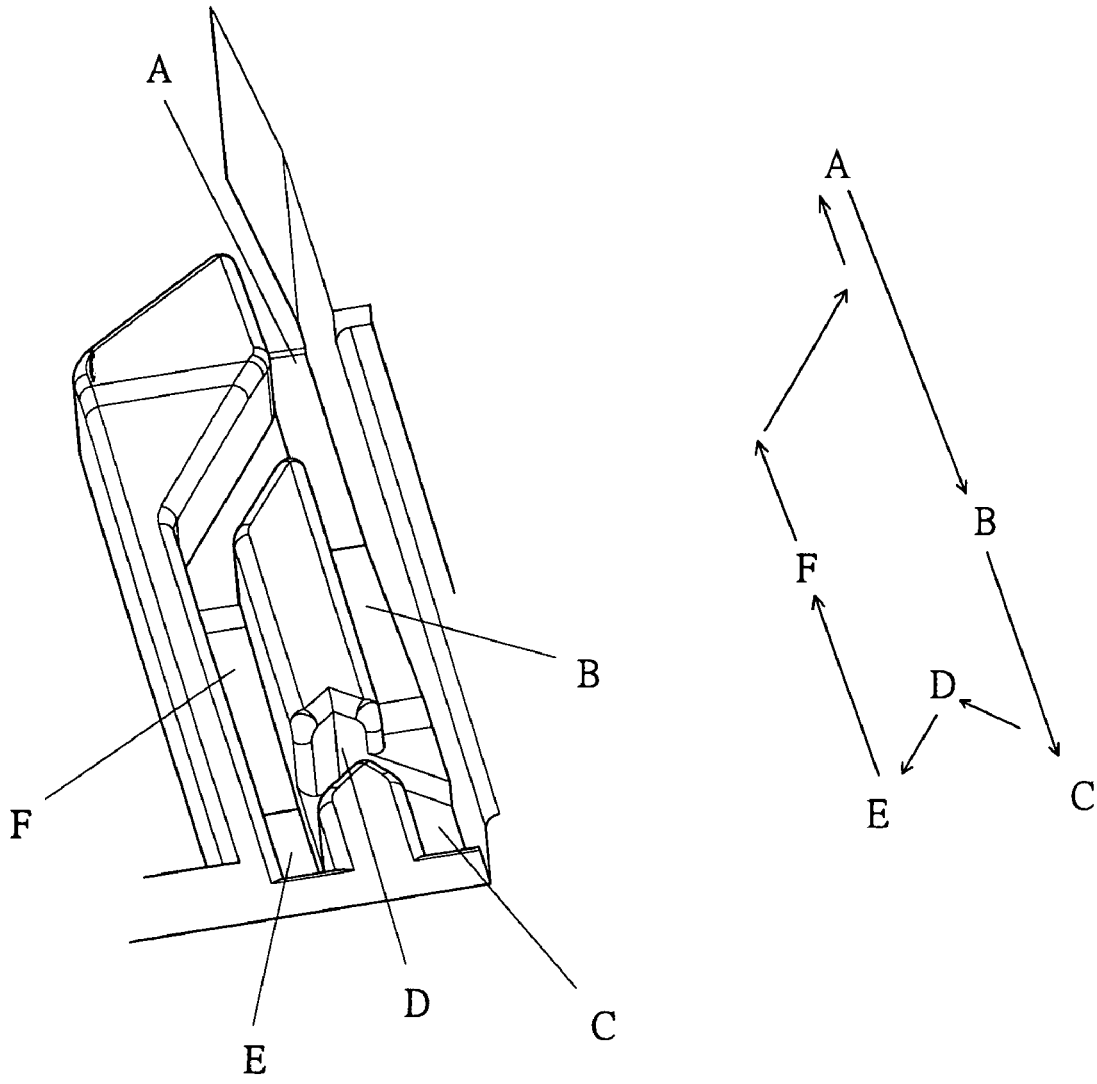
FIG. 7 is a schematic view of the path of the clasping portion moving within the circular guiding groove.
Figure 7A:
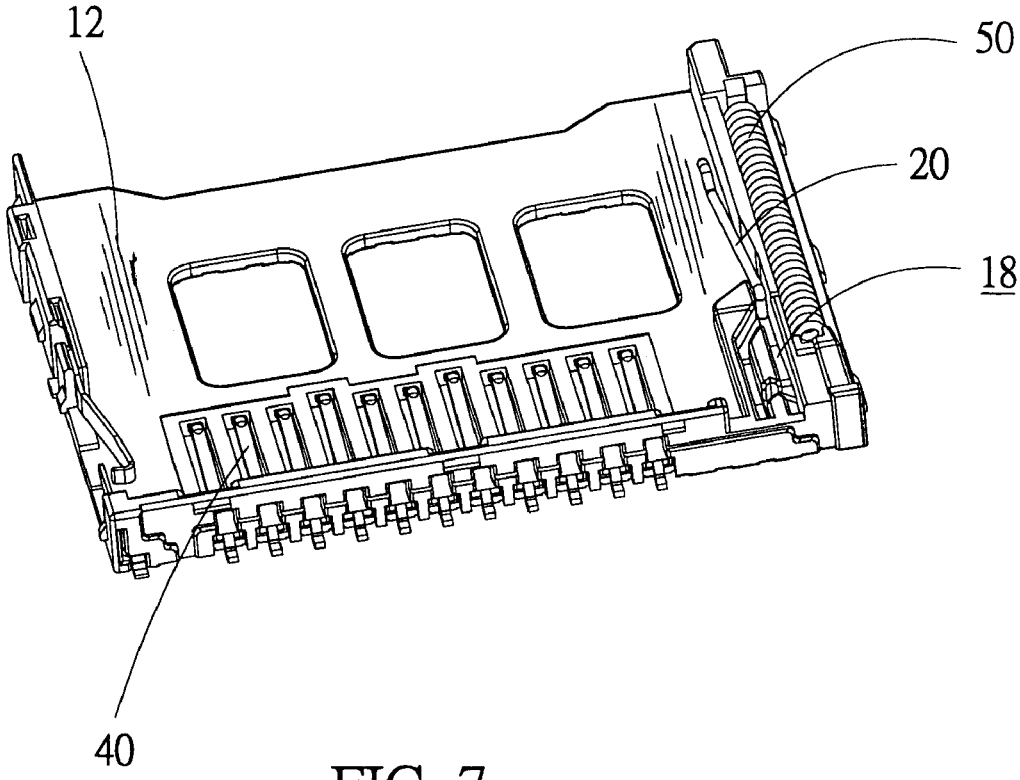
FIG. 7*a* is a schematic view of the clasping portion located at position A of the circular guiding groove.
Figure 7B:
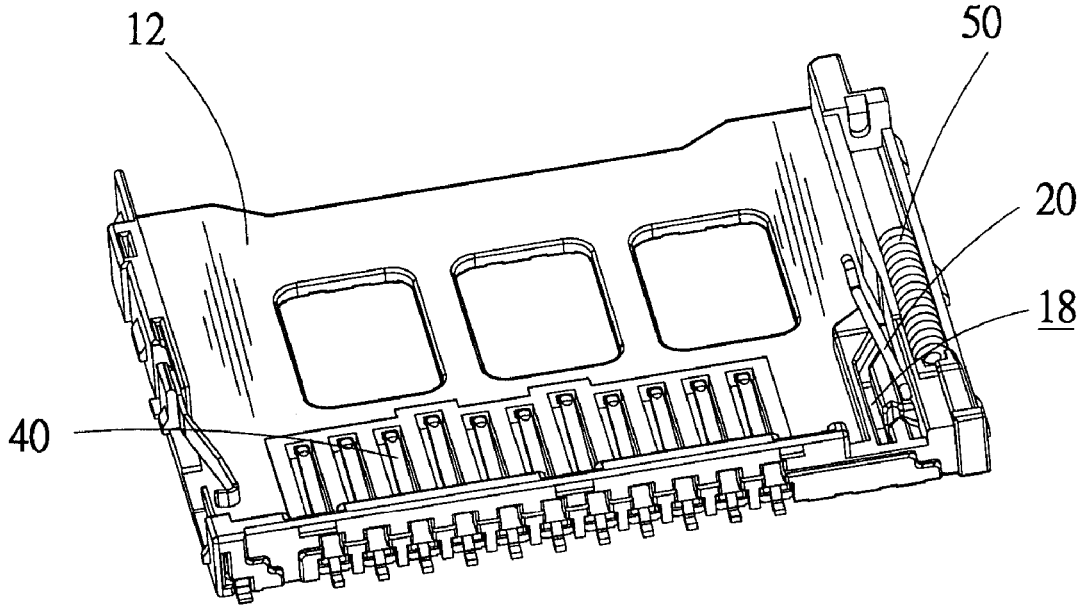
FIG. 7*b* is a schematic view of the clasping portion located at position B of the circular guiding groove.
Figure 7C:
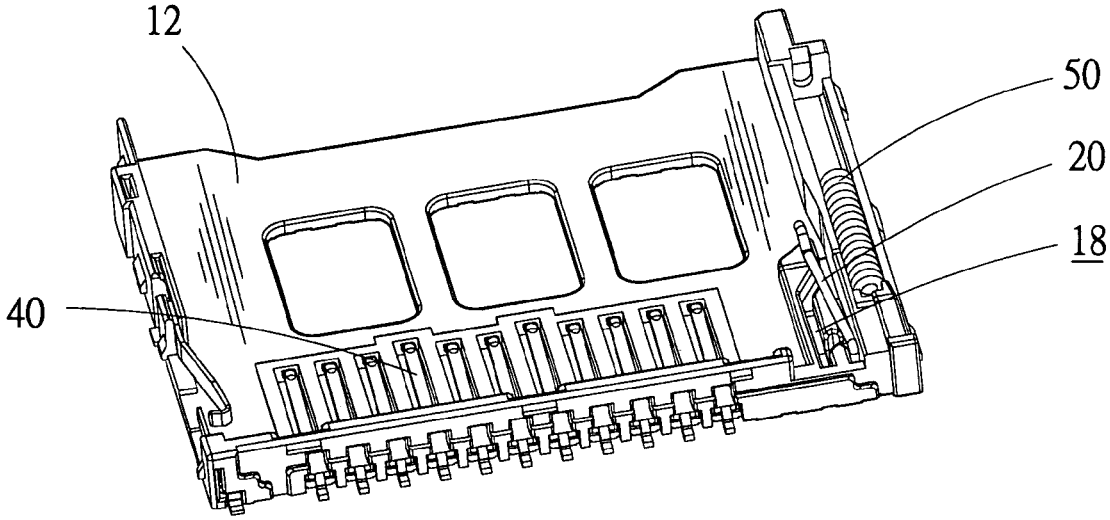
FIG. 7*c* is a schematic view of the clasping portion located at position C of the circular guiding groove.
Figure 7D:
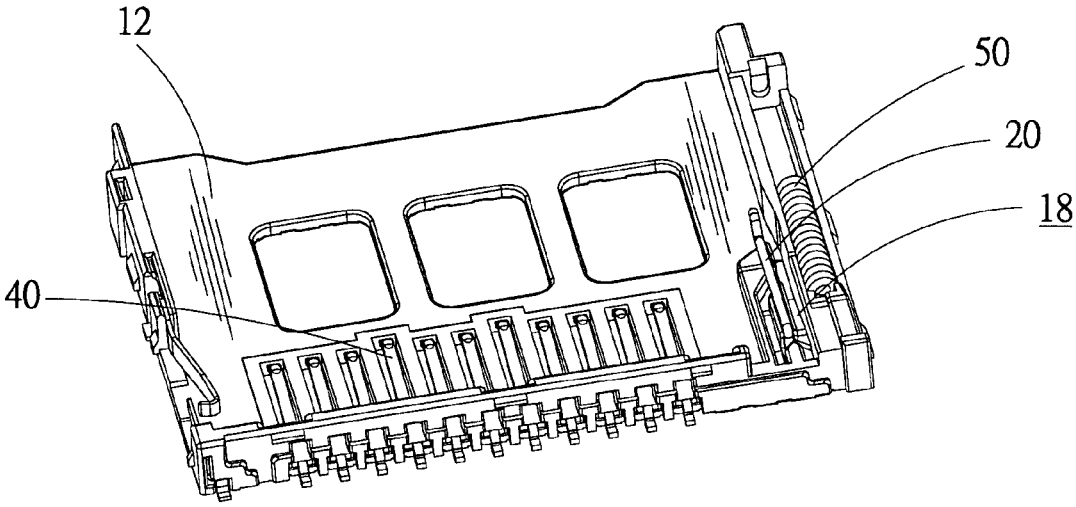
FIG. 7*d* is a schematic view of the clasping portion located at position D of the circular guiding groove.
Figure 7E:
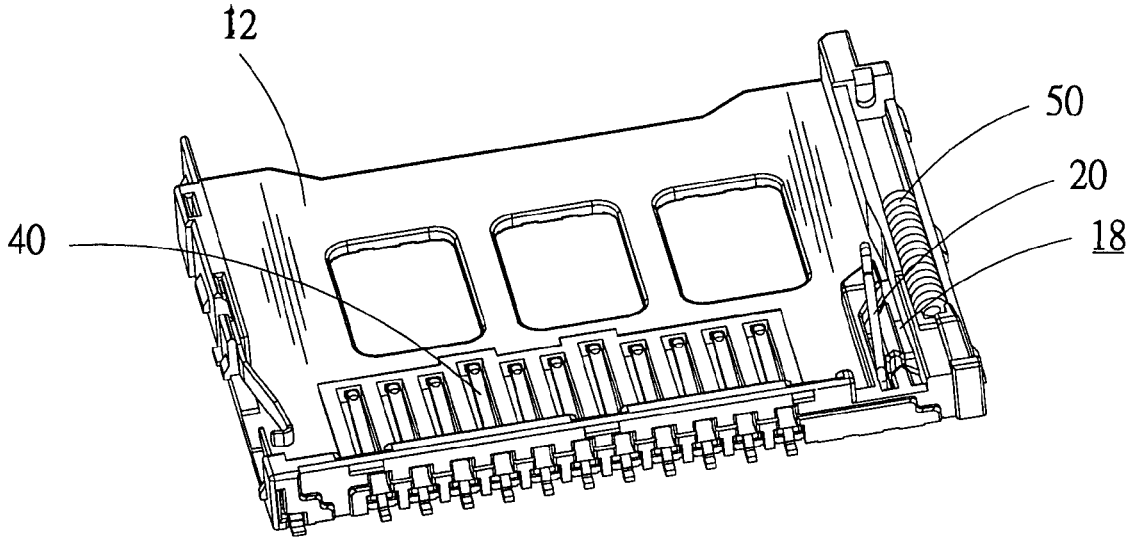
FIG. 7*e* is a schematic view of the clasping portion located at position E of the circular guiding groove.
Figure 7F:
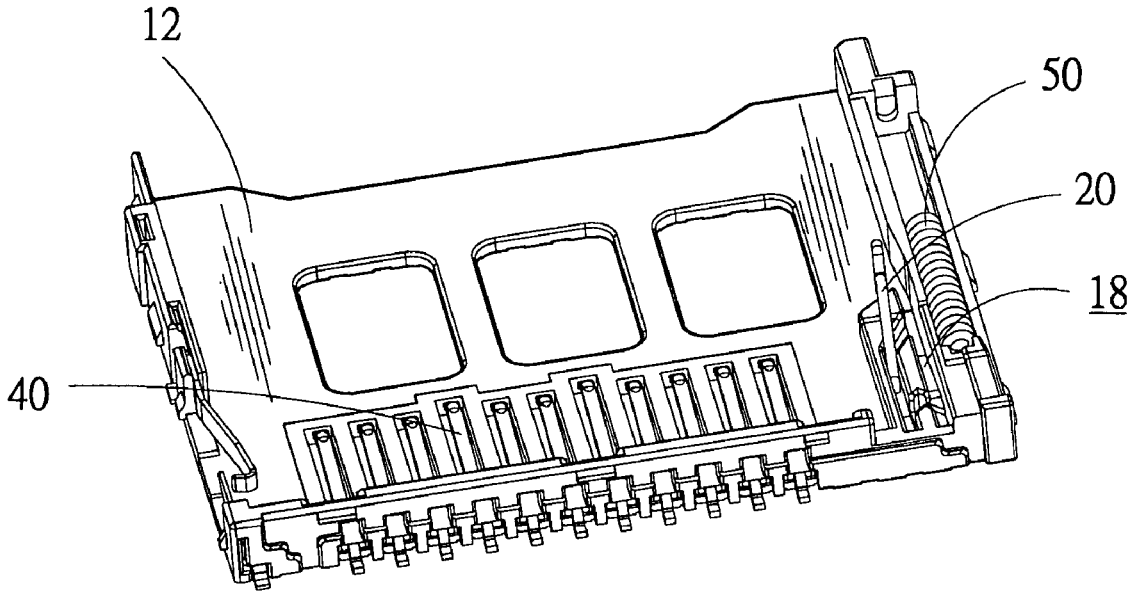
FIG. 7*f* is a schematic view of the clasping portion located at position F of the circular guiding groove.

Please refer to FIG. 7 and FIG. 7*a* to FIG. 7*f*. FIG. 7 is the diagram illustrating the movement of the clasping portion 24 in the circular guiding groove 18. FIG. 7*a* to FIG. 7*f* are the views of each state of the clasping portion 24 in the circular guiding groove 18. The clasping portion 24 is at the position A when the sliding member 30 is stayed in the rejection state. The sliding member 30 is pushed from the rejection state to the insertion state, meanwhile, the clasping portion 24 is pushed from position A to position B. Because of the boundary of the position B and position C is a slanted step, the clasping portion 24 cannot back to position B from position C after the clasping portion 24 is pushed past the boundary between position B and position C. The sliding member 30 has been in the insertion state since the clasping portion 24 reached the position C. As the sliding member 30 has the restoring force toward the direction of rejection by pressing the resilient member 50, the clasping portion 24 will slide to the position D and retained at the position D after reaching the position C. Thus, the sliding member 30 can be retained in the insertion state.

The sliding member 30 is pushed a little distance toward the direction of insertion for pushing the clasping portion 24 out of the position D and forward to the position E when the sliding member 30 is rejected from the insertion state to the rejection state. Similarly, the boundary of the position D and the position E is a slanted step, hence the clasping portion 24 cannot back to the position D from the position E. The clasping portion 24 will continue to slide through the position F to the position A along the circular guiding groove 18 due to the restoring force of the sliding member 30. The sliding member 30 is retained in the rejection state after the clasping portion 24 reached the position A. Because of the boundary of the position F and the position A is a slanted step, the clasping can be pushed forward to the position B instead of the position F from the position A when the sliding member 30 is pushed from the rejection state to the insertion state next time.

In contrast to the prior art, the sliding member 30 of memory card connector 10 in accordance with the present invention is provided with the recess portion 32. The linkage portion 22 of the sliding pin 20 is in a slanted S-shape and obliquely penetrated through the retaining hole 34 of the recess portion 32. The clasping portion 24 is formed on the end of the sliding pin 20 opposite to the linkage portion 22. The top of the sliding pin 20 is substantially at the same level as the surface of the sliding member 30. The structure combined of the recess portion 32 of the sliding member 30 and the sliding pin 20 is able to reduce the thickness of the memory card connector and minimize the probability of failure.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A memory card connector with a push-push mechanism comprising:

a housing;

a plurality of terminals set on the housing for electrically connecting with the adapted terminals of a memory card;

a circular guiding groove set on the housing;

a sliding pin bent into a specific shape, the sliding pin including a linkage portion and a clasping portion, wherein the clasping portion is located at predetermined positions of the circular guiding groove in a proper sequence, the linkage portion having a slanted S-shaped contour formed on one end of the sliding pin, the clasping portion being formed on an opposing end of the sliding pin and bent downward into a substantially right angle;

a sliding member that is slid to corresponding positions according to the insertion and the rejection of the memory card, the sliding member having a recess portion formed on a front end thereof, and a retaining hole formed in the recess portion, the linkage portion of the sliding pin extending through the retaining hole and thereby retained thereat with an extending distal portion being supoorted on the recess portion, an indented depth of the recess portion on the sliding member being substantially equal to a thickness of the sliding pin, and thereby a top surface of the sliding pin being substantially at a same level with a top surface of the sliding member, and a resilient member disposed with one end thereof against the housing and the other end thereof against the sliding member for providing the sliding member with a restoring force toward the direction of rejection.

2. The memory card connector with a push-push mechanism as claimed in claim 1, wherein the housing further comprising a projecting portion which is extended inwardly at an angle for preventing the insertion of the memory card in wrong directions.

3. The memory card connector wit a push-push mechanism as claimed in claim 1, wherein a guiding rod is disposed on the housing, a guiding hole is formed on the sliding member, the guiding rod is penetrated through the guiding hole for constraining the sliding member in a predetermined area.

4. The memory card connector with a push-push mechanism as claimed in claim 3, wherein the resilient member is a hollow coiled spring in a cylindrical shape which wraps around the outside of the guiding rod.

* * * * *